US005713710A

United States Patent [19]

Strong et al.

[11] Patent Number: 5,713,710

[45] Date of Patent: Feb. 3, 1998

[54] TRANSFER SYSTEM

[76] Inventors: Philip Anton Strong, 63 Cromwell Road., Aberdeen, United Kingdom, AB1 6UE; Roger John Catherall, 42 Mount Street, Aberdeen, United Kingdom, AB2 4QT

[21] Appl. No.: 522,280

[22] PCT Filed: Mar. 7, 1994

[86] PCT No.: PCT/GB94/00437

§ 371 Date: Oct. 25, 1995

§ 102(e) Date: Oct. 25, 1995

[87] PCT Pub. No.: WO94/21511

PCT Pub. Date: Sep. 29, 1994

[30] Foreign Application Priority Data

Mar. 13, 1993 [GB] United Kingdom ..... 9305185
Dec. 2, 1993 [GB] United Kingdom ..... 9324780

[51] Int. Cl.[6] ..... B63B 38/00

[52] U.S. Cl. ..... 414/139.5; 114/350

[58] Field of Search ..... 414/137.1, 138.2, 414/138.4, 139.5; 114/362, 365, 349, 350

[56] References Cited

U.S. PATENT DOCUMENTS

| | | | |
|---|---|---|---|
| 2,876,919 | 3/1959 | True et al. . | |
| 2,998,148 | 8/1961 | Himel, Jr. | 414/139.5 |
| 3,259,926 | 7/1966 | Otterman . | |
| 3,896,515 | 7/1975 | Otterman . | |
| 4,166,517 | 9/1979 | Henderson | 114/362 |
| 4,180,363 | 12/1979 | Stair | 414/139.5 |
| 4,195,595 | 4/1980 | Shimonovich . | |
| 4,395,178 | 7/1983 | MacDonell et al. | 414/139.5 |
| 4,412,598 | 11/1983 | Kimon et al. | 414/139.5 |
| 4,630,542 | 12/1986 | Peyre et al. | 414/139.5 |
| 4,713,030 | 12/1987 | Ingle | 440/99 |
| 4,739,721 | 4/1988 | Peyre | 414/139.5 |
| 4,822,311 | 4/1989 | Doerffer et al. | 441/87 |
| 4,858,775 | 8/1989 | Crouch | 414/139.5 |

FOREIGN PATENT DOCUMENTS

| | | | |
|---|---|---|---|
| 0053770 | 11/1981 | European Pat. Off. . | |
| 0104983 | 4/1984 | European Pat. Off. . | |
| 1484775 | 6/1989 | U.S.S.R. | 414/139.5 |
| 1533944 | 1/1990 | U.S.S.R. | 414/139.5 |
| 920474 | 6/1963 | United Kingdom . | |
| 1180343 | 4/1970 | United Kingdom . | |
| 1502921 | 8/1978 | United Kingdom . | |
| 2136037 | 12/1984 | United Kingdom . | |
| 9212892 | 6/1992 | WIPO . | |

*Primary Examiner*—Karen B. Merritt
*Assistant Examiner*—Douglas Hess
*Attorney, Agent, or Firm*—Ratner & Prestia

[57] ABSTRACT

A transfer apparatus for transferring objects from a first location to a second location includes a transfer device adapted to be coupled to a lifting device. The transfer device comprises an outer structure which defines an inner space in which an object to be transferred may be located and securing device is provided to secure the object to the transfer device during transfer.

17 Claims, 14 Drawing Sheets

TRANSFER SYSTEM

This invention relates to the transfer of personnel and/or equipment, for example between vessels at sea. Existing methods of achieving transfer have significant limitations in terms of safety and practicality. Such operations are particularly sensitive to weather. This invention offers a system which reduces the risks associated with transfer in a range of weather conditions.

In this field it is already known that there are several methods of transfer, which include those outlined below.

The main method currently used for transfer of personnel between offshore oil rigs and support vessels is a rigid bottomed rope basket. The basket is usually transferred using a crane line.

This has the disadvantage that personnel are not secured in the basket and are not protected in any way from lateral or vertical impact during lifting, setting down or in transit.

As it swings over the vessel moving with sea swell, the crane hook and lifting gear presents serious risk to personnel on the support vessel. Furthermore, there is no contingency to protect personnel in the event of accidental immersion or severance.

Due to the perceived hazards of this type of transfer it is no longer generally used in open water in the UKCS (United Kingdom continental shelf), but it is used between vessels in sheltered water.

A second method of transfer is a ladder transfer. In this method the smaller craft draws alongside the larger craft and personnel are transferred by means of a ladder on the side of the larger craft. Due to the relative motions of the vessels at sea, this requires personnel to "hop" across at an opportune moment.

This has the disadvantage that it is highly weather constrained and generally precarious in terms of safety.

A third method of transfer is a breeches buoy system. This is a traditionally used system for transferring personnel or equipment between marine vessels. It is mainly utilised in rescue operations.

This has the disadvantage that the transfer is generally precarious add is vulnerable to operator error.

In accordance with a first aspect of the present invention, apparatus for transferring objects from first location to a second location comprises a transfer device adapted to be coupled to a lifting device, the transfer device comprising an outer structure which defines an inner space in which an object to be transferred may be located and securing means to secure the object to the transfer device during transfer.

Typically, the object may be a person and the securing means could comprise a seat and/or a harness. Preferably, the harness is a full body harness.

Preferably, the outer structure could be in the form of a cage which is typically substantially rigid to help protect the object being transferred.

Typically, the first and/or the second location could be a floating structure.

Preferably, where a part of the transfer is over water, the transfer device may also include buoyancy means. Typically, the transfer device may be designed to be self-righting.

Typically, the transfer device may further include shock absorbing means for absorbing impacts of the transfer device with other objects. The shock absorbing means may include shock absorbers on the base of the outer structure to absorb the shock of landing at the first and/or second locations. The securing means could also be mounted in the outer structure by shock absorbing means to help reduce the effects of accidental or deliberate collision on the object being transferred. Furthermore the transfer device may include a shock absorbing coupling to couple the transfer device to the lifting device.

Preferably, the apparatus may also include a guide line coupled to the transfer device which may be used to guide the transfer device to the second location.

Typically, the lifting device is a crane.

In accordance with a second aspect of the present invention, a transporting device comprises a base section and a number of side walls, the side walls extending from the base to a common apex, the base section and the side walls defining an interior space in which an object may be located.

Preferably, the base is in the form of a polygon, and side walls extend from each side of the polygon.

Typically, the shape defined by the base section and side walls is generally the shape of a pyramid and is preferably a triangular pyramid.

Preferably, the transporting device is adapted to transport human personnel and may typically include a seat and restraining means within the interior space.

Preferably, the transporting device is positively buoyant where it is intended to use on water or near water.

Typically, the transporting device may have a self-righting capability in water. Preferably, the transporting device may include a keel in or below base section to enhance the self-righting performance of the transporting device.

Preferably, the common apex is coincident with a vertical axis through the centre of the base section.

Typically, the base section may include shock absorbing means, and the device may include attachment means, typically adjacent to or at the common apex to permit the transporting device to be lifted.

Examples of a transfer system in accordance with the invention will now be described with reference to the accompanying drawings, in which:

FIG. 1 is a schematic view of a transfer system having a first example of a transfer capsule in use between two vessels;

FIGS. 2*a* and 2*b* are a side view and a top view, respectively of the first example of the transfer capsule shown in FIG. 1;

FIG. 3 is a cross sectional view of a lifting assembly on the transfer capsule of FIGS. 2*a* and 2*b;*

FIGS. 4*a* and 4*b* are a side cross-sectional view and a plan cross-sectional view of the transfer capsule of FIGS. 2*a* and 2*b*, in use;

Figure 13A:
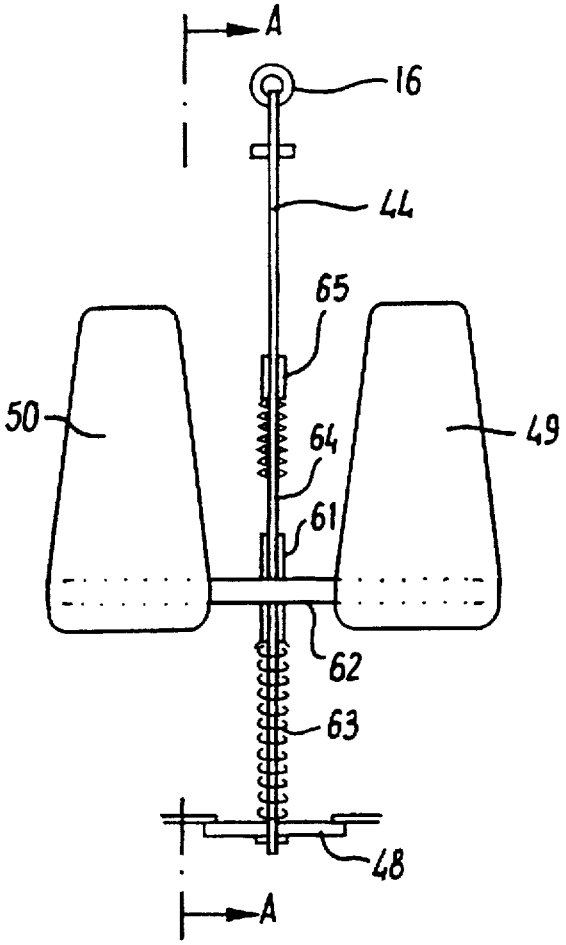
Figure 13C:
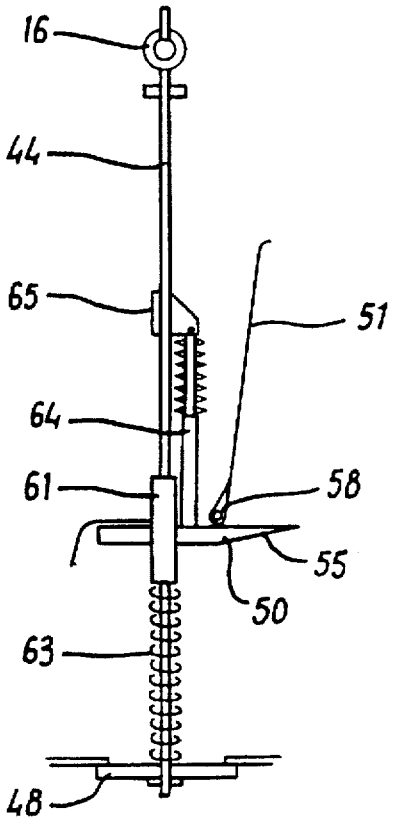
Figure 13B:
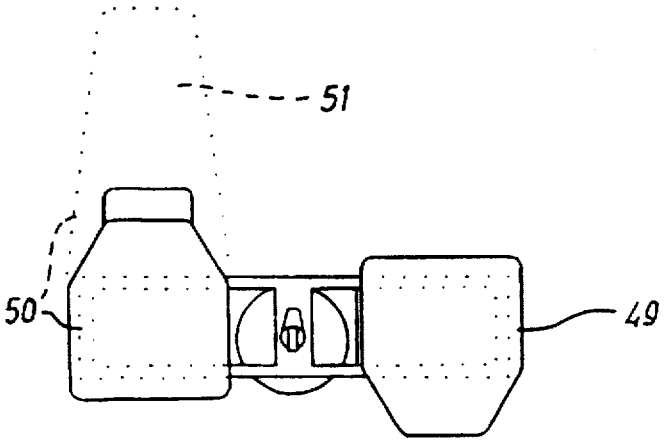
Figure 14:
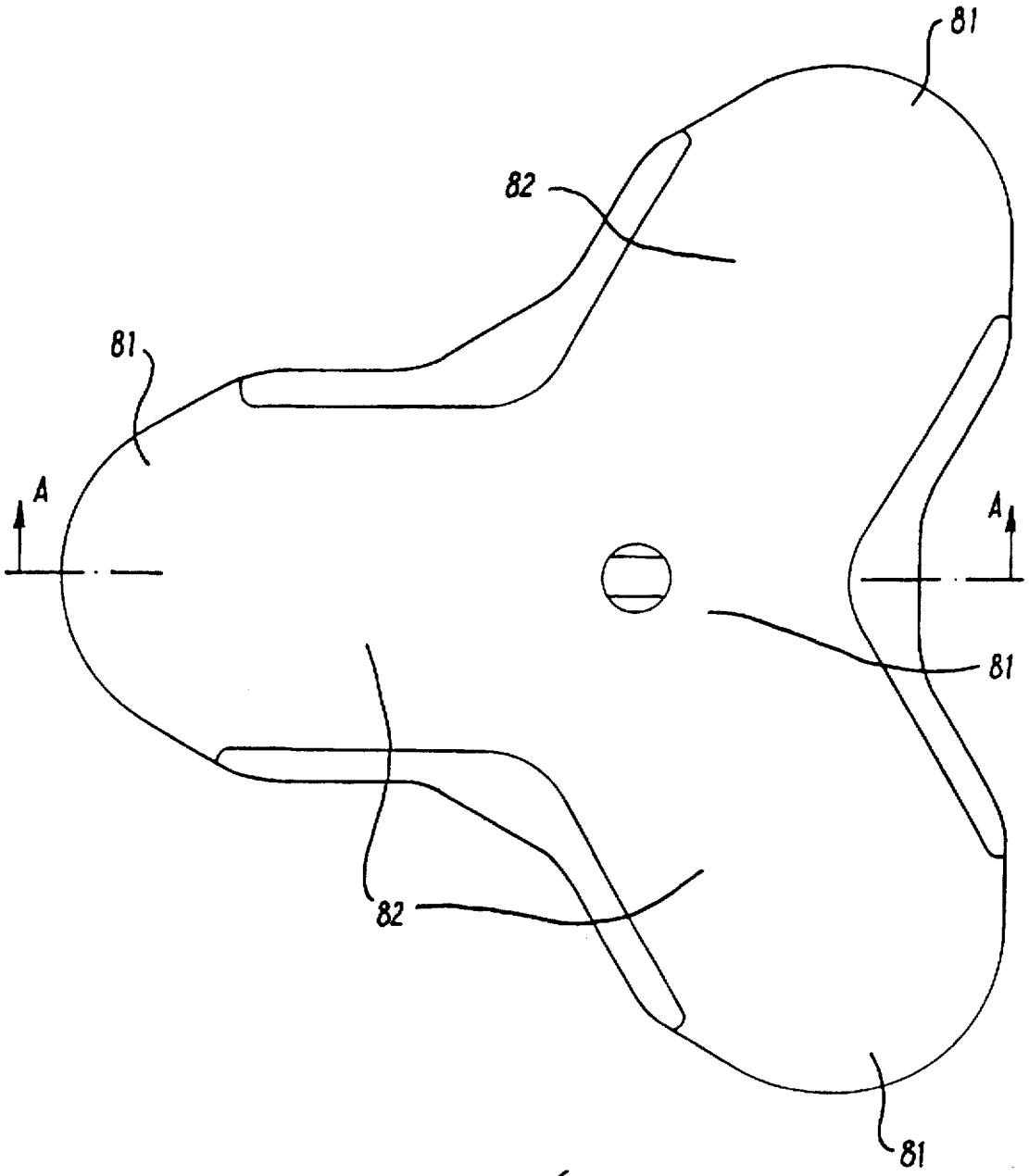
Figure 15:
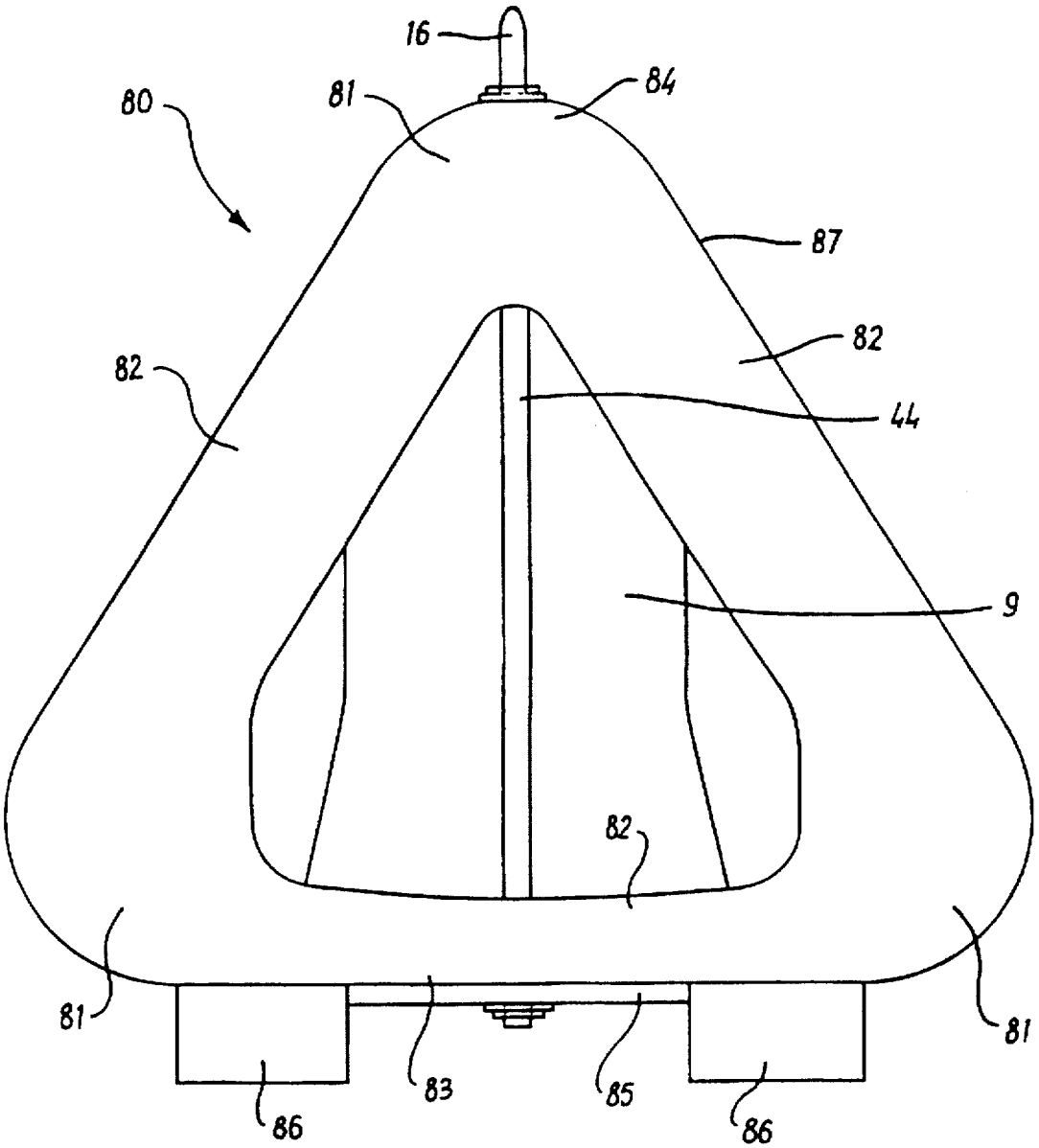
Figure 16:
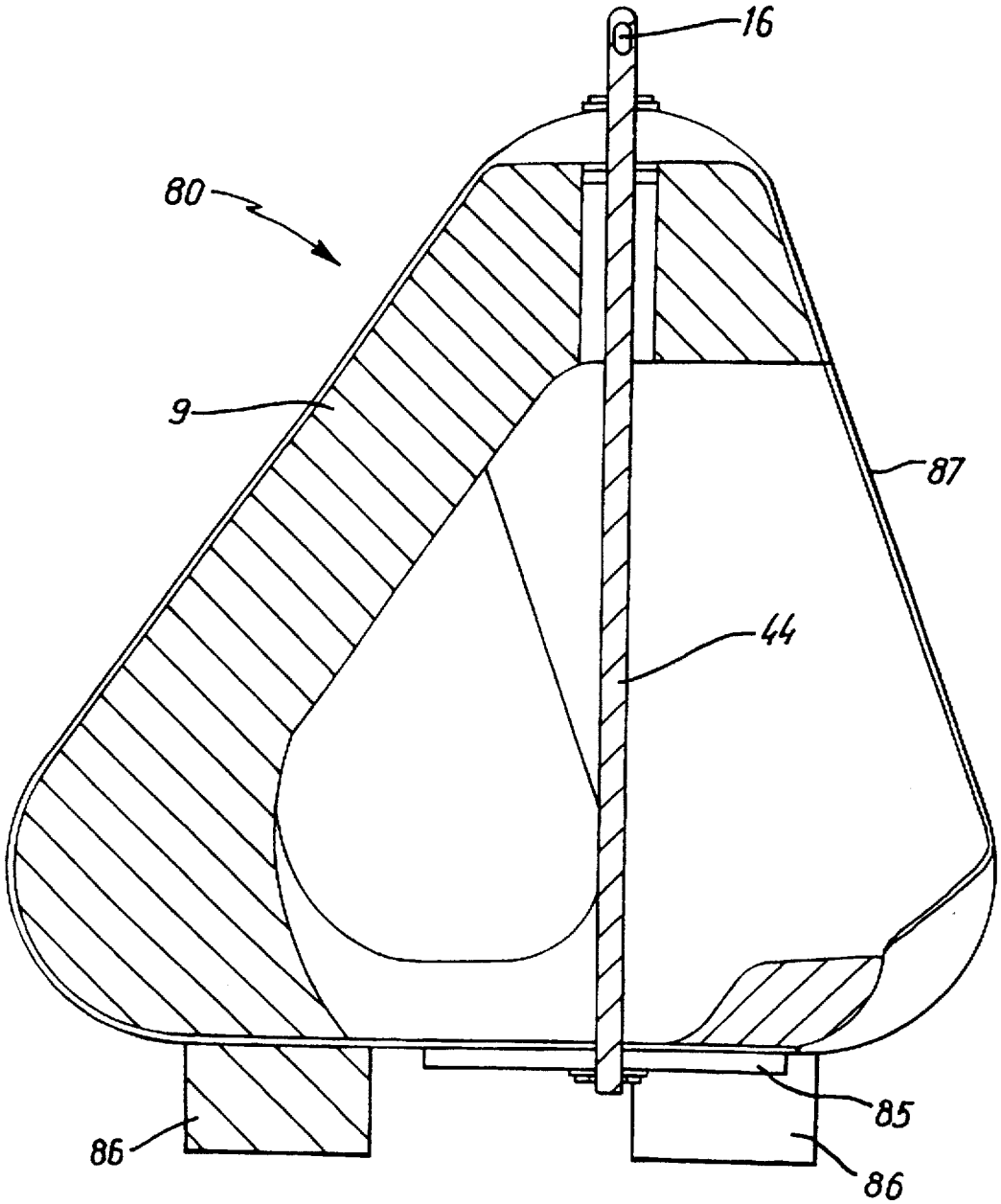
Figure 17:
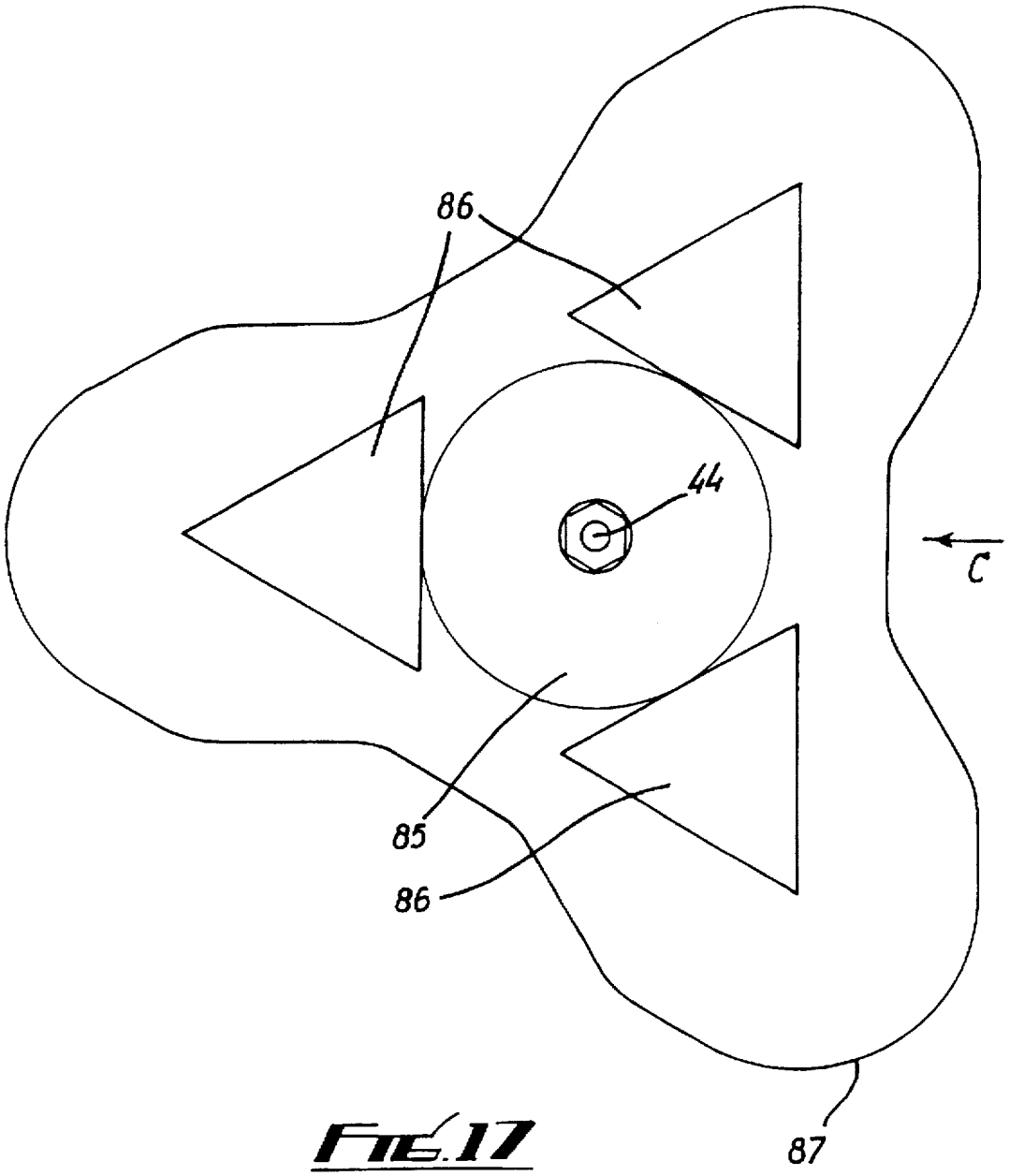

FIGS. 13*a*, 13*b* and 13*c* show a front elevational view, a plan view, and a view on the line AA in FIG. 13*a*, respectively of the seating arrangement in the second transfer capsule;

FIG. 14 is a top view of a third example of a transfer capsule;

FIG. 15 is side elevation of the third transfer capsule shown in FIG. 14;

FIG. 16 is partial cross-sectional view of the third capsule on the line AA of FIG. 14; and, FIG. 17 is a bottom view of the third transfer capsule.

Figure 1:
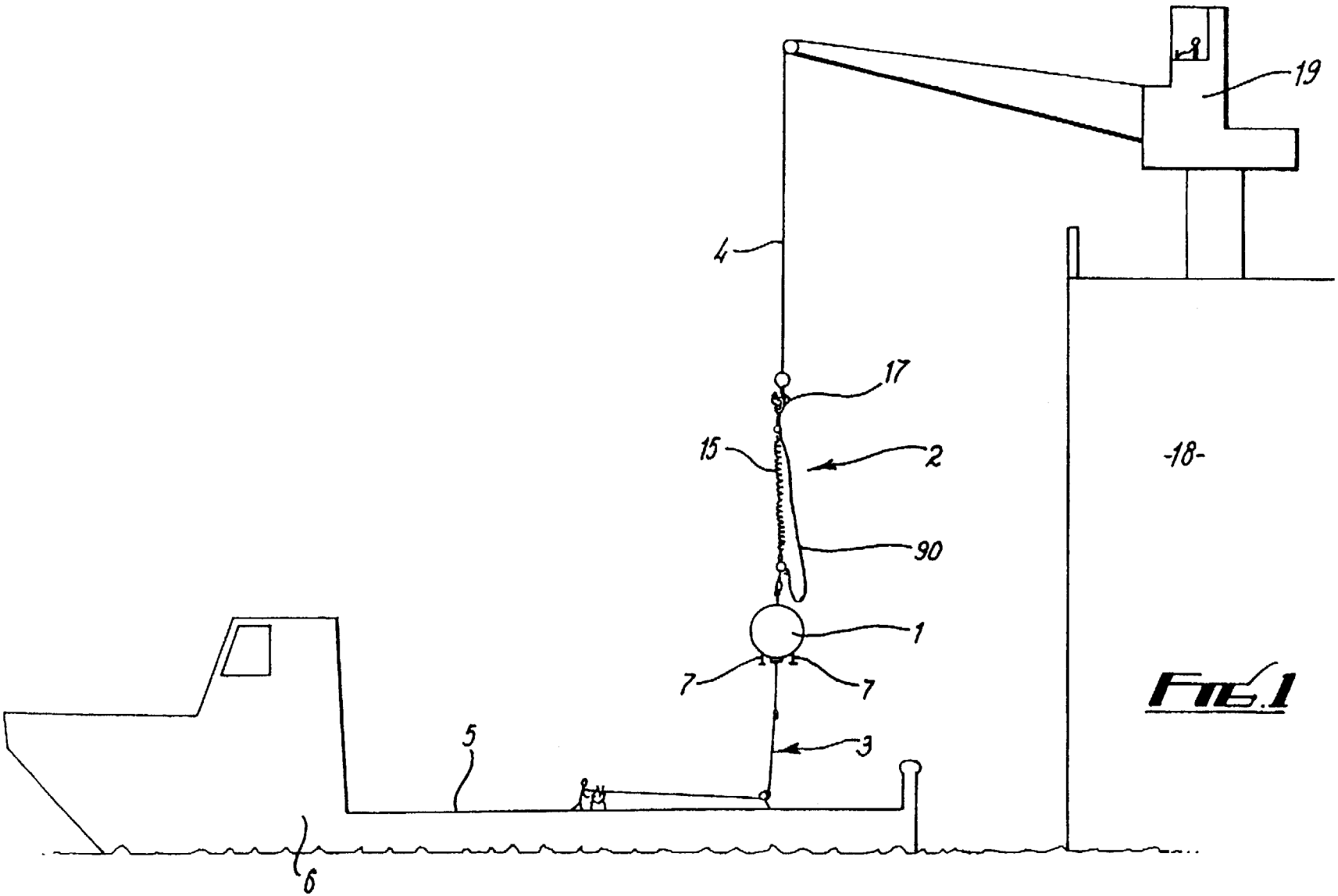

A first example of a transfer system is shown in FIG. 1 and consists of a first example of a transfer capsule 1 which is in the form of a structurally enclosed rigid capsule 1 offering protection to personnel or equipment during transfer between vessels at sea. The system comprises a crane 19 mounted on a first vessel 18, the crane can be operated to pick up and transfer the capsule 1 using a crane hook 17. The system is provided with shock absorption and motion compensation features 2, 3 to minimise the risk of damage to equipment or injury to personnel during transfer. The capsule 1 will usually be buoyant and self-righting to minimise the risks to personnel in the event of inadvertent immersion. The capsule 1 will generally be constructed of materials which are not prone to corrosion or early deterioration.

With the rigid capsule system, the robust structure of the capsule 1 is designed to protect one or more passengers against injury caused by lateral loads (such as those caused by impact due to the swinging motion of a crane line 4 during the capsule transfer) or by vertical impacts (such as those occurring during lifting and setting down of the capsule 1 on the deck 5 of a vessel 6). The capsule 1 is fitted with some shock absorption system 7 (such as hydraulic cylinders, springs, air cushions or a deformable substance like rubber) on the underside, to reduce the impact forces imparted when the capsule 1 makes contact, for example with the deck 5 of the vessel 6.

The capsule 1 is fitted with means of securing passengers 10 and freight 12 in a safe position during transfer, such as a full harness 9 used to secure the passengers in a seated position. A head restraint 8 is also incorporated to protect the passengers 10 against whiplash. Passengers will be protected against the effects of impact on the capsule 1 by an energy absorbing medium such as dense foam or particular polystyrene. Alternatively, this may be achieved by suspending a seat 14 using tensioned elements 13 in such a manner that these will dissipate the energy of the impact.

Luggage or freight 12 will generally be secured within the capsule 1 in such a way that it will not be dislodged in the event of any impact. The weight and position of any item of luggage 12 will be controlled to ensure that it has no adverse effect on either the buoyancy or the self righting characteristics of the capsule 1.

The capsule 1 is shaped and constructed to minimise the changes of snagging on adjacent structures during operation. For example the upward facing outer profile of the capsule 1 may be rounded (or egg shaped) so that it deflects away from, rather than catches on, any parts of the vessels structure in which it comes into contact.

With the buoyancy capsule system, the capsule 1 will comprise sufficient buoyancy to prevent personnel from becoming permanently submersed in the event that the capsule is immersed (for example by becoming detached from its lifting gear). This will be provided by some form of closed cell (water proof) foam, placed in the internal part of the capsule (shaped to accommodate the passenger as required i.e. possibly forming a seat) or mounted on the periphery of the capsule.

With the self righting capsule system, the capsule 1 is configured to provide a self righting feature when it is immersed in water. This is achieved by ensuring that the capsule in unstable when upside down. In this position its centre of gravity will be above the water line and any displacement results in a righting moment causing the capsule to roll over and revert to its upright position.

With the compensated handling system 2, a sprung linkage 15 (such as elastomeric rope or metallic spring) is deployed between a lifting eye 16 of the capsule and a crane hook 17. A safety line 90 is coupled in parallel across the spring compensator 15. The sprung linkage 15 has the effect of maintaining tension in the lifting gear when the capsule 1 is being set down or picked up and therefore acts as a shock absorption mechanism. The travel of the sprung linkage 15 is sufficient to maintain tension over the anticipated range of relative heave motion between the decks of the vessel 6 and the vessel 18. This same mechanism also prevents sudden changes in lifting gear tension when the capsule 1 is picked up, thus minimising the potential for damage caused by the rope snagging or the capsule striking the deck of a vessel.

The use of the sprung link 15 provides motion compensation when tension is applied to a line 3 from the vessel 6 which is connected to the underside of the capsule (see FIG. 1). The line attached to the vessel 6 maintains a fixed length (when it is not being wound in by a winch) and the relative heave motion of the two vessels will be compensated for by the changes in length of the sprung link 15. Tension will be continuously applied to the capsule from above and below and thus its descent will be controlled with the capsule moving in sympathy with the vessel heave. Such a line 3 also improves the accuracy of landing the capsule 1 on the vessel 6 and reduces the chances of impact due to the uncontrolled swinging of the capsule 1 close to the vessel 6.

A lightweight slinging system reduces the hazards involved in handling heavy or rigid lifting tackle in the proximity of a vessel moving with a sea swell.

The capsule will usually be buoyant and self-righting to minimise the risks of personnel in the event of inadvertent immersion.

Figure 2A:
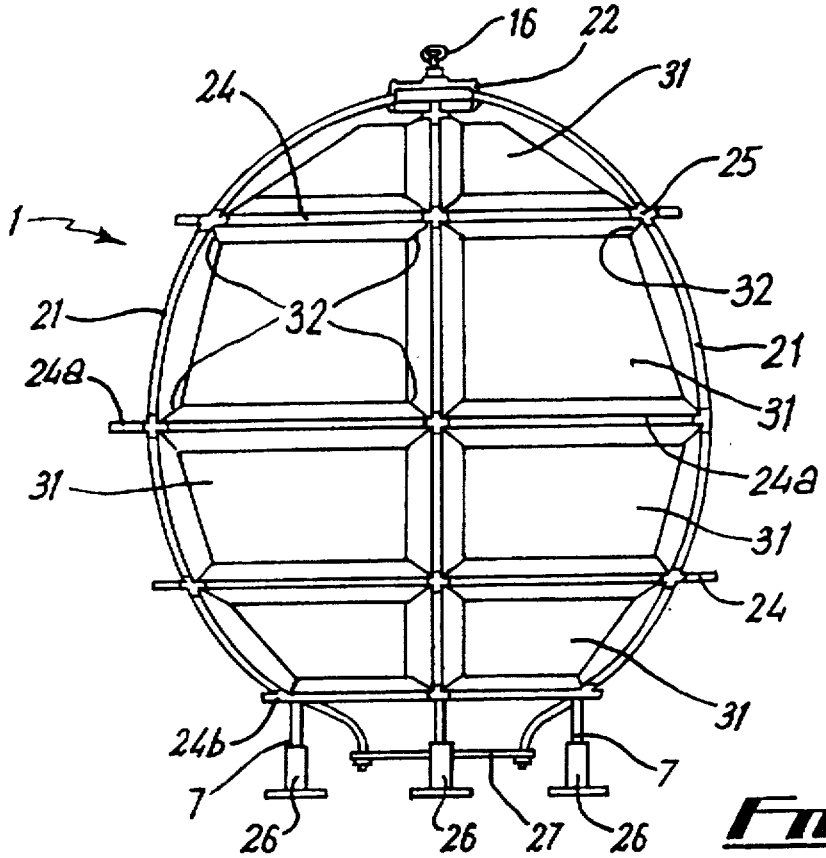
Figure 2B:
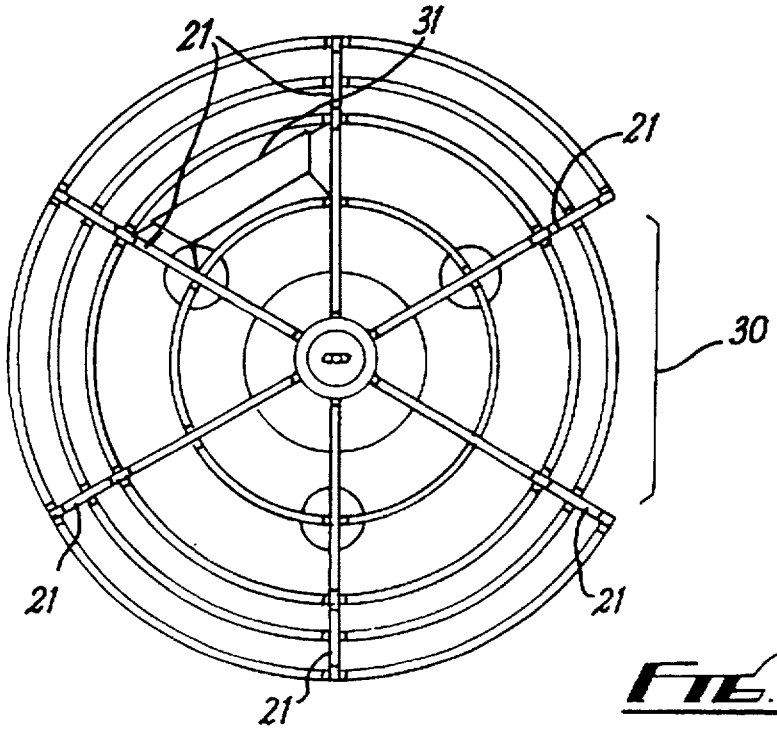

As shown in FIG. 2, the capsule 1 has a broadly egg shaped frame 20 which is constructed from six individual members 21 of 1" diameter steel tubing. Each member 21 is formed into a roughly semi-circular shape. The members 21 converge at the top of the capsule and are connected into a bracket 22, which also allows for connection of a central lifting eye 16. The assembly of the lifting eye 16 and members 21 at the top 22 is further detailed in FIG. 3.

Figure 3:
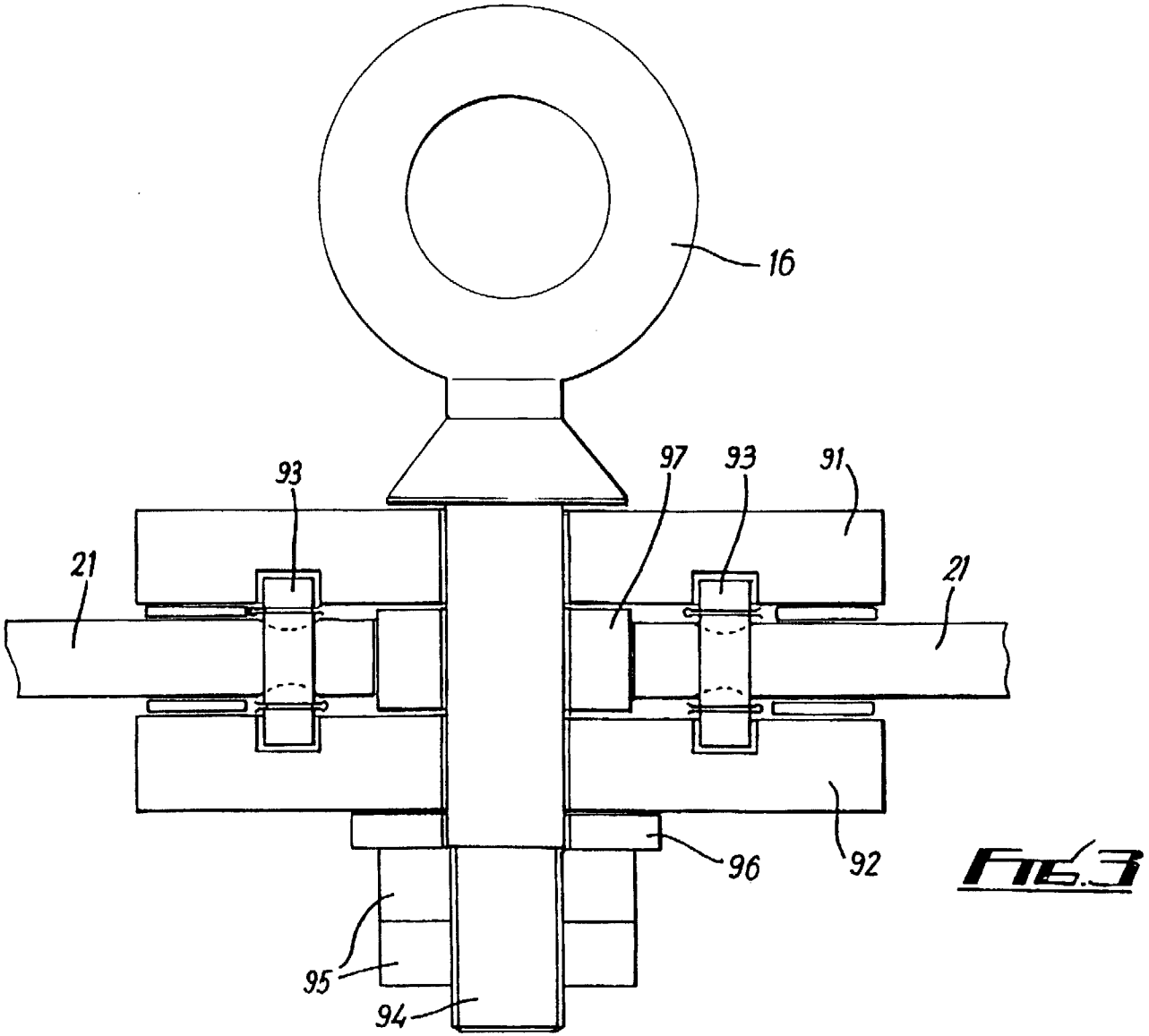

As shown in FIG. 3, the members 21 are each coupled to an upper grooved disc plate 91 and a lower grooved disc plate 92 by a retaining pin 93. A stem 94 of the lifting eye 16 passes through central apertures in the plates and is retained by two hexagonal nuts 95 and a washer 96. An elastomer washer 97 separates the stem 94 from the ends of the members 21 and also provides a spacer between the plates 91, 92.

At the base of the structure three of the members 21 are formed into landing feet 26, while the remaining members 21 are connected to a keel 27.

Horizontal members 24, also of 1" diameter steel tube, are formed into a circular shape and connected to the principal members 21 using mechanical unions 25. These members add strength to the overall structure as well as providing added protection. The central horizontal structural hoop 24*a* is left open over one of the six segments to provide an opening 30 for access.

The lower horizontal hoop member 24*b* forms the support for a steel mesh floor 29, which may be welded in place or attached with bolted brackets. Straps 30 fixed to the floor 29 provide for securing of luggage or freight 12.

At the base of the capsule, three of the main tubular members 21 are bolted through onto the keel 27. The keel 27 is a flat circular plate of steel. As the capsule is required to be self righting in water, lead plates can be bolted onto the keel 27 to provide the appropriate turning moment for effective self-righting.

The remaining three vertical tubular members 21 are provided with sprung feet 26 which provide shock absorption when the capsule is landed. The feet 26 use spring and damping mechanisms similar to those in common use for motorcycle and motor car suspension systems. The three feet 26 are well spaced in an equilateral triangle, thereby providing a stable base for the capsule to land on, even on an uneven surface.

The capsule is rendered buoyant by the addition of foam panels 31 attached to the frame around the periphery of the capsule. The foam panels 31 are made by sandwiching a steel mesh between two sheets of foam. The panels 31 are fixed at the nodes 25 of the frame by tensioned wires 32 attached to the steel mesh. The function of the buoyancy is to keep the capsule 1 afloat and to provide its self-righting characteristic. Sufficient buoyant foam will be used to ensure that in the event of immersion the passenger's upper body will remain above the water line. The panels 31 are evenly distributed around the frame to ensure the capsule 1 will be self-righting from any attitude.

Figure 4A:
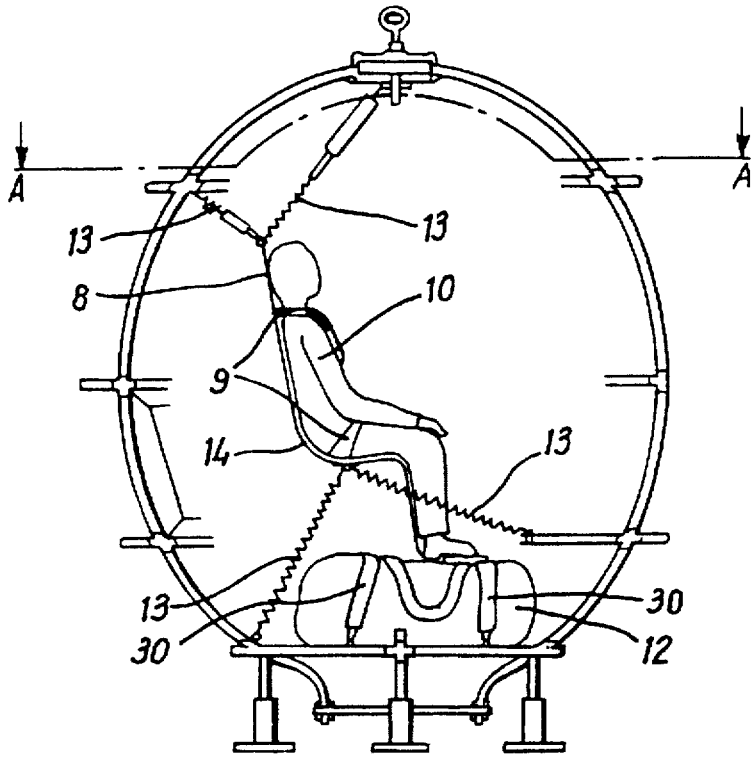
Figure 4B:
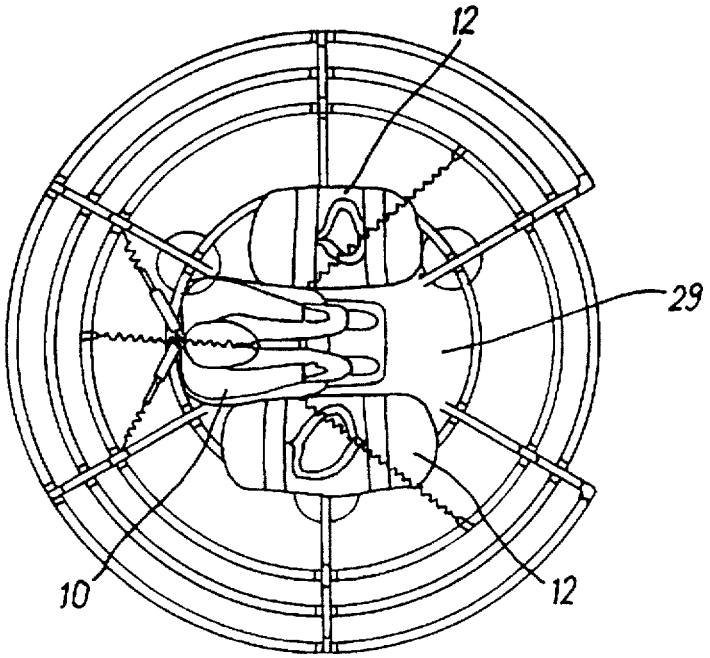

The passenger seat 14 is a plastic moulding "bucket style" seat providing head support 8 (to protect against "whiplash") and full safety harness 9. As shown in FIG. 4, the seat 14 is secured in place by sprung tension elements 13 with shock absorption in the upper elements (above the seat) to provide energy dissipation in the event of a heavy landing.

Figure 5:
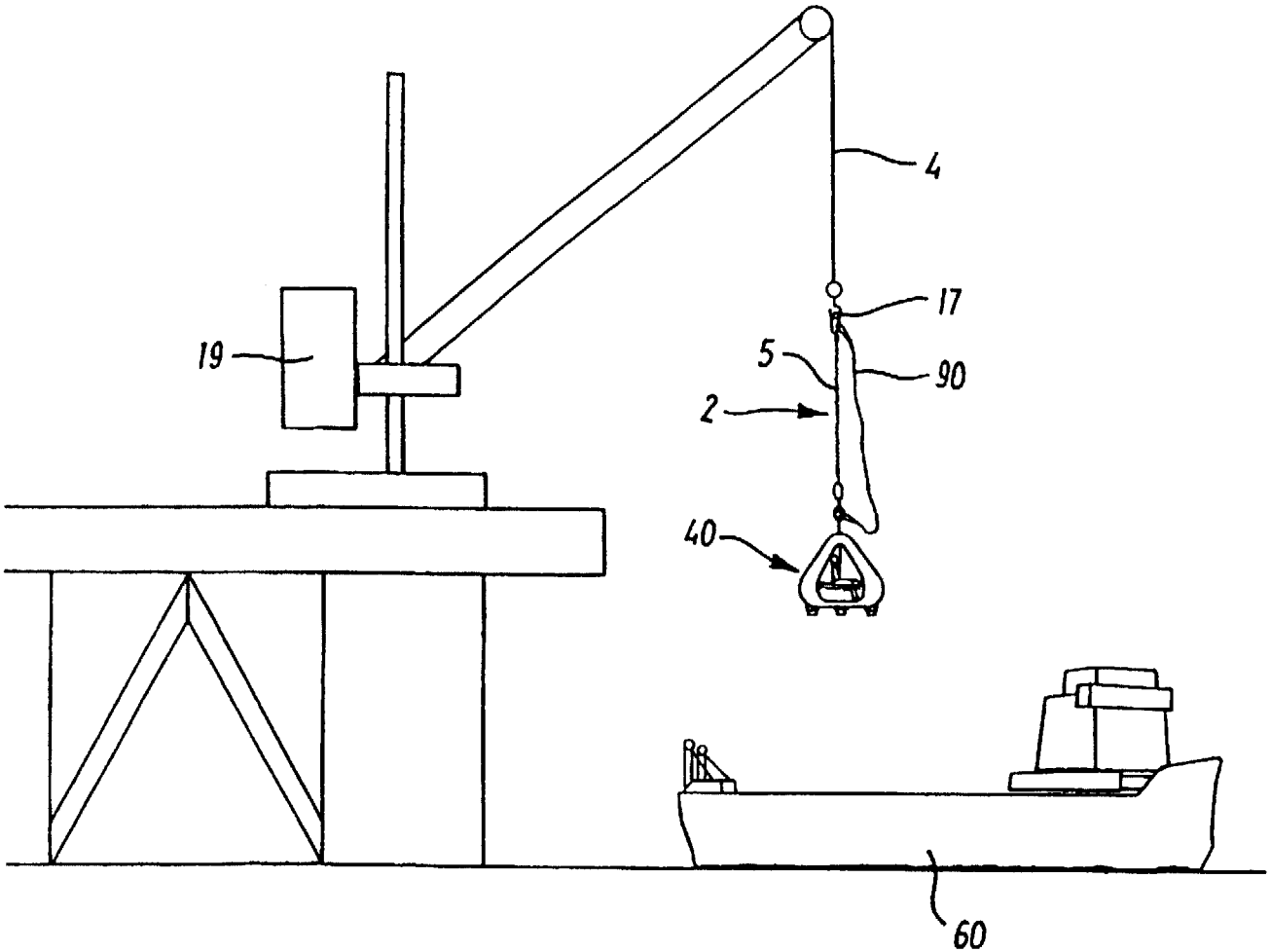
FIG. 5 is a schematic view of a transfer system having a second example of a transfer capsule, the system being used for transferring objects from a fixed structure to a vessel.

The second example of a transfer system shown in FIG. 5 shows a structurally enclosed capsule 40 which is strong and may be rigid. It is specifically shaped and fitted with buoyant material such that it will float in water providing support for its occupants and will tend to be self-righting in the event that it is inverted or turned on its side in water. The shape and construction of the capsule are such that it is strong enough to carry the personnel and freight for which it is designed and will withstand impacts during use.

The shape coupled with the weight and buoyancy distribution make the structure relatively stable in water and it will tend to be self-righting in the event of capsize. The shape is also inherently strong and resistant to damage from impact loads. The simplicity of the shape allows economical manufacture. The capsule will offer protection to personnel or equipment appropriate to the application for which it is designed whether that by as a means of escape from a vessel or as a rescue aid or as part of a system for transfer between vessels at sea or as a craft for any other purpose.

The shape of the capsule is such that it has a flat, wide base, usually broadly in the shape of a regular polygon. The sides of the structure converge at the top of the structure to form a single apex. The corners of the base and the top apex may be rounded. Typically examples of the shape would be the modified tetrahedrons shown in FIGS. 6 to 12 and 14 to 17.

Buoyant material is attached to the pillars or sides joining the apex to the base. Sufficient buoyant material may also be attached elsewhere to ensure that the capsule floats at an appropriate height in the water when it is fully loaded according to the application for which the specific example is designed. The capsule may be constructed from glassfibre or other moulded plastics or may be fabricated from tubular shaped or planar sections of metal or plastic.

The capsule may be provided with a central shaft passing through the top apex and the centre of the base which is connected to the main shell of the capsule and provides a facility by which the capsule may be lifted. A frame may be attached to this shaft which may provide a base for seats, stretcher bearers or other structures which may be used for attaching personnel freight or luggage. This frame may be affixed to the central shaft in such a way as to allow it to slide up and down the shaft to allow adjustment of weight distribution when loading the capsule. Springing, shock absorbing and motion compensating arrangements may also be included to provide protection from shock to passengers or freight during deployment, recovery or transfer.

The robust structure is designed to protect the passenger against injury caused by lateral loads (such as those caused by the capsule colliding with an object or structure during deployment, transfer or when otherwise in use) or by vertical impacts (such as those occurring during lifting and setting down of the capsule on the deck of a vessel or elsewhere). The capsule may be fitted with some shock absorption system (such as hydraulic cylinders, springs, air cushions or a deformable substance like rubber or foam) on the underside, to reduce the impact forces imparted when the capsule makes contact, for example with the deck of a vessel.

The capsule will generally be fitted with a means of securing passengers and freight in a safe position during transfer, deployment or general use, such as a full harness used to secure the passengers in a seated position. Luggage will generally be secured within the capsule in such a way that it will not be dislodged in the event of any impact. The weight and position of passengers, luggage and freight will be controlled to ensure that it has no adverse effect on either the buoyancy or the self-righting characteristics of the vessel.

The capsule is shaped and constructed to minimise the chances of snagging on adjacent structures during operation. For example, the upward facing outer profile of the capsule will be rounded (or egg shaped) so that it deflects away from, rather than catches on, any parts of the vessel in which it comes into contact.

Where the capsule is required to be buoyant, it will comprise sufficient buoyancy to prevent personnel from becoming permanently submersed when the capsule is immersed. Usually this will be provided by some form of closed cell (water proof) foam, placed in the frame of the capsule or mounted on the periphery of the capsule.

It is a particular feature of the invention that buoyancy is placed at the periphery of the capsule between the base and the apex, for example on the inside of pillars joining the base and apex, as this adds to the self-righting capability of the capsule and improves its stability when floating in water.

The capsule design is configured to provide a self-righting feature when it is immersed in water. This is achieved by ensuring that the capsule is unstable when upside down. In this position its centre of gravity will be above the water line and any displacement results in a righting movement causing the capsule to roll over and revert to its upright position.

It is a particular feature of the design that the upper sections of the capsule are made buoyant. This provides a righting force in the event that the capsule is inverted in water. The capsule thus tends to roll onto one side. By ensuring that there is sufficient force acting outside the base of the capsule to overcome any buoyant forces at the base the capsule will tend to roll into an upright position. This force is achieved by the distribution of weight at or below the level of the base to provide a keel. For maximum efficiency this weight is concentric with the vertical axis passing through the centre point of the base and apex of the capsule. The specific shape of the capsule has a low centre of gravity which greatly assists in the self-righting process.

In the second transfer system shown in FIG. 5, the arrangement of the transfer system is essentially the same as the transfer system shown in FIG. 1. However, the transfer capsule 40 is different. The capsule 40 is shown in more detail in FIGS. 6 to 13*c*. The capsule 40 has an outer shell 41 which is constructed from moulded glass reinforced plastic (GRP), according to established methods. The outer fibreglass skin is approximately 10 mm thick to produce a strong monocoque construction. The outer shell 41 has a base 42 which is further reinforced with a pre-formed glassfibre mesh 43.

A central steel shaft 44 passes through holes in the base and apex and is connected to the shell 41 by threading the ends of the shaft 44 and fitting washers and nuts above and below the fibreglass at both base 42 and apex 45. The shaft 44 is also fitted with a lifting eye 16 at its upper end. The shaft 44 provides a support by which the capsule 40 may be lifted. A seating and stretcher attachment arrangement 50 is attached to the shaft 44 and is shown in more detail in FIGS. 13*a* to 13*c*. The capsule 40 is also provided with a water activated light 98 which may be used as a location device if the capsule 40 becomes detached from the crane hook 17 and lands in the water.

The capsule 40 is rendered buoyant by the addition of foam 46 attached to the pillars 47 joining the base 42 and the apex 45 of the capsule 40. Foam (not shown) is also positioned at apex 45 itself. Additional buoyancy may be incorporated at the base 42 of the capsule. The function of the buoyancy is to keep the capsule 40 afloat and to provide it with self-righting characteristics. Sufficient buoyant foam 46 is used to ensure that in the event of immersion a passenger's upper body will remain above the water line. The buoyancy is evenly distributed around the frame to enhance the self-righting capabilities of the capsule 40. The self-righting capabilities of the capsule 40 can be further improved by attaching a metal disk 48 to the bottom of the shaft 44 to form a simple keel 48.

Figure 7:
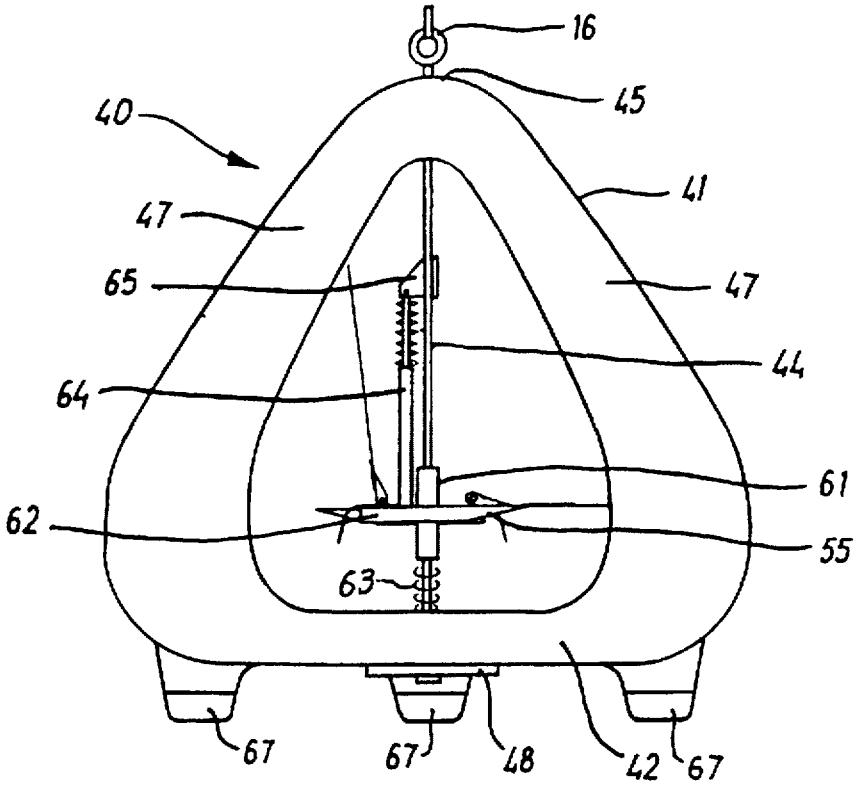
FIG. 7 is a front elevation, similar to FIG. 6 but with the suspension system not omitted.
Figure 8:
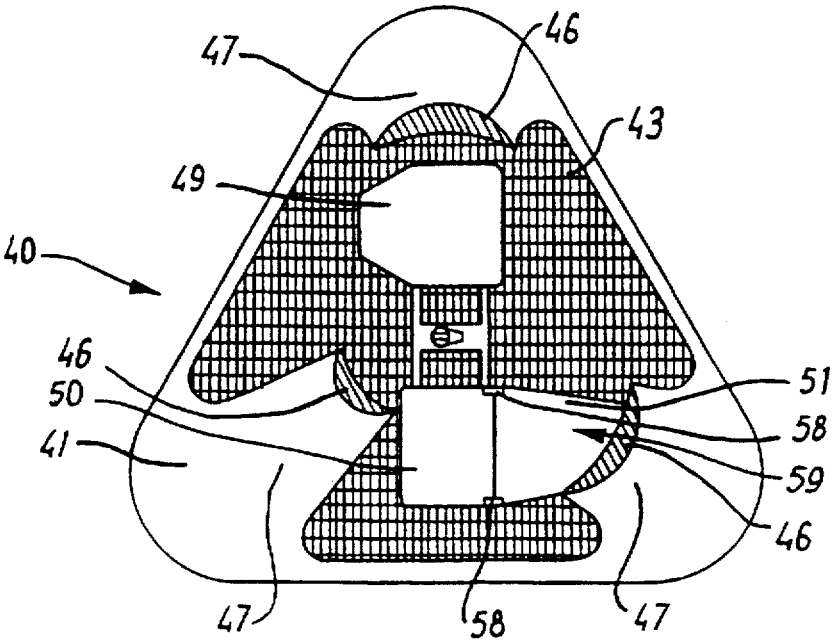
FIG. 8 is cross-sectional view through the top of the second example of the transfer capsule.
Figure 9:
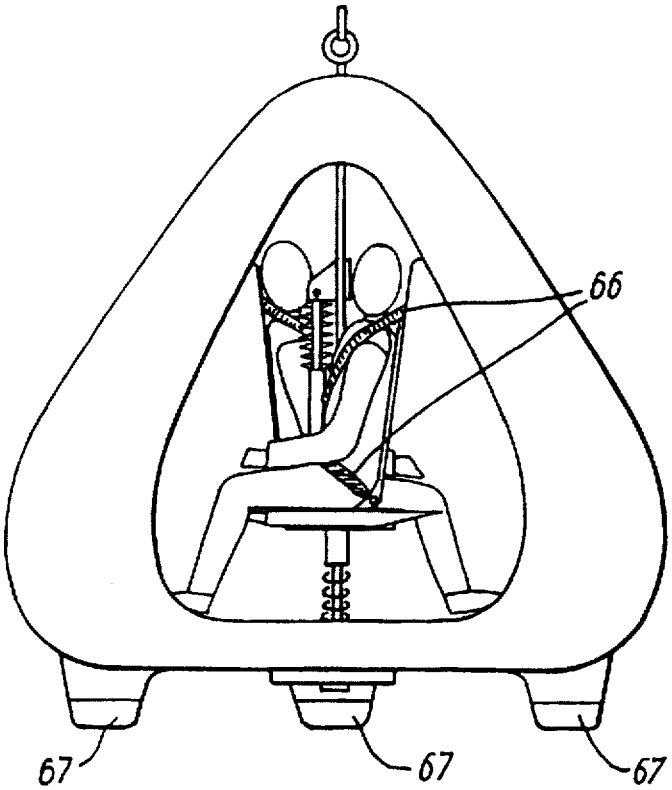
FIG. 9 is a front elevation showing the second transfer capsule in a first use.
Figure 10:
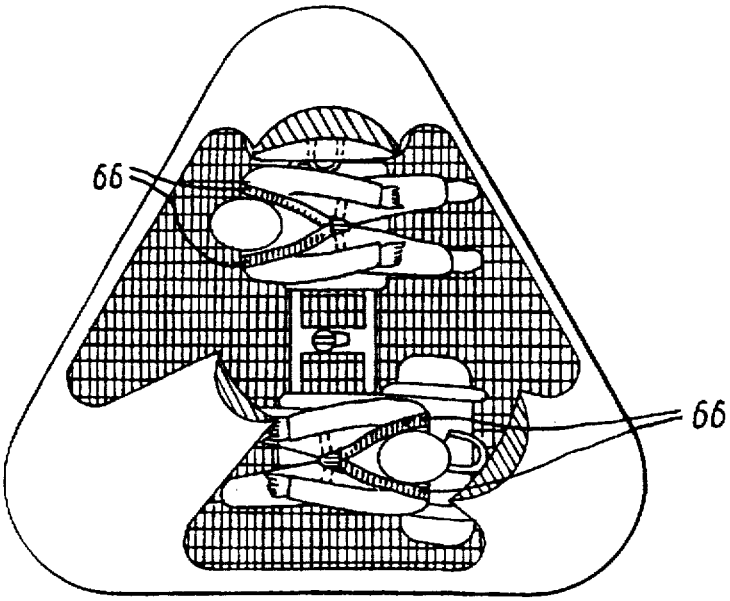
FIG. 10 is a top cross-sectional view showing the second transfer capsule in the first use.
Figure 11:
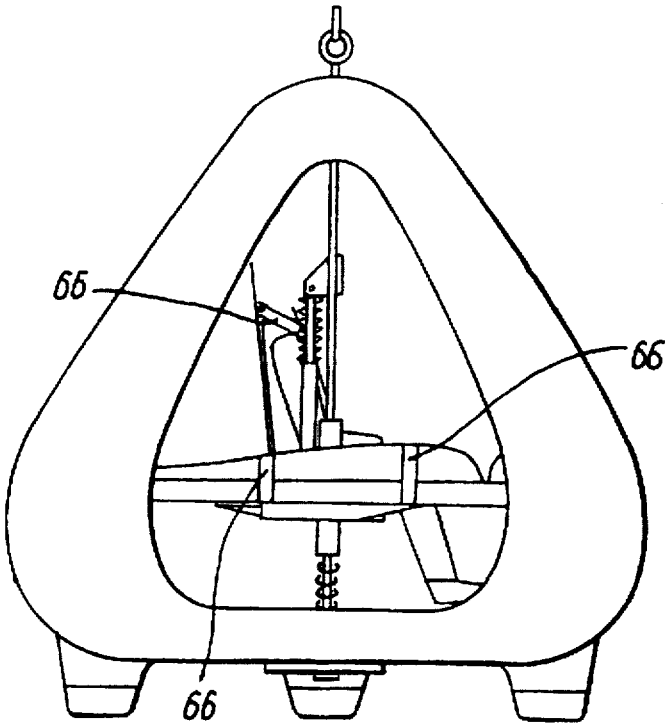
FIG. 11 is a front elevation showing the second transfer capsule in a second use.
Figure 12:
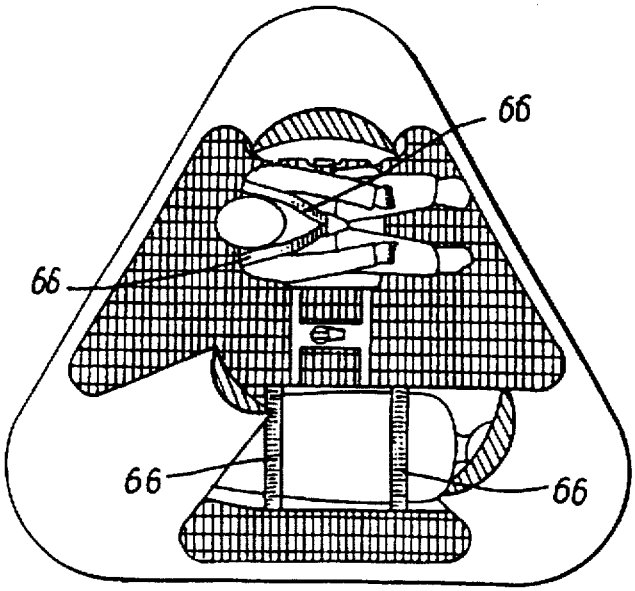
FIG. 12 is a top cross-sectional view showing the second transfer capsule in the second use.

FIGS. 7 and 8 show the seating arrangement in place in the capsule 40. The seating arrangement comprises two seats 49, 50 side by side and on opposite sides of the shaft 44. A backrest 51 of one of the seats 50 is hinged 58 so that it can be folded flat to provide a platform 59 for a stretcher. FIGS. 9 and 10 show the capsule 40 in use with the seats 49, 50 arranged for two seated passengers. FIGS. 11 and 12 show the capsule 40 in use with the backrest 51 of seat 50 horizontal so that the capsule 40 may accommodate one seated passenger and one stretcher.

FIGS. 13*a* to 13*c* show the details of the seating arrangement. A cylindrical metal sleeve 61 is fixed to a frame 62 constructed from steel box section which forms a mounting base for the seats 49, 50. The sleeve 61 fits closely over the shaft 44 allowing the seat base frame 62 to slide but preventing excess lateral movement. A spring 63 is also slid over the shaft 44 between the keel 48 of the capsule 40 and the bottom of the metal sleeve 61. This provides shock absorption directly through the seating assembly when the capsule 40 is picked up or landed. A pneumatic or hydraulic cylindrical shock absorber 64 is fitted at one of its ends to the seat mounting base frame 62 and at its other end to a clamp 65. The clamp 65 is in turn fitted around the shaft 44 and locked in place. The shock absorber 64 provides a damping force which prevents uncontrolled bouncing of the seating frame 62 up and down the shaft 44. Because the shock absorber 64 is fixed to the shaft 44 and to the seating base frame 62 it also prevents the metal sleeve 61, seating base frame 62 and seats 49, 50 from rotating relative to the shaft 44.

The seats 49, 50 are moulded plastic of glassfibre and feature high backs to provide neck restraint. At least one of the seats 50 is hinged 58 at the bottom of the seat back 51 so that the back 51 can be laid flat to provide a horizontal base onto which a stretcher can be strapped. Base 55 of the seat 50 extends beyond its junction with the seat back 51 to provide support for the seat back 51 when it is folded flat. The seats 49, 50 are provided with full harness seats belts 66 to hold passengers securely.

Three feet 67 are attached close to the corners of the base 42. The feet 67 are made of a firm but compressible foam such as polyethylene, which provides shock absorption when the capsule 40 is landed. The triangular arrangement of the feet 67 ensures that the capsule 40 will be as stable as possible when standing on an uneven surface.

Figure 6:
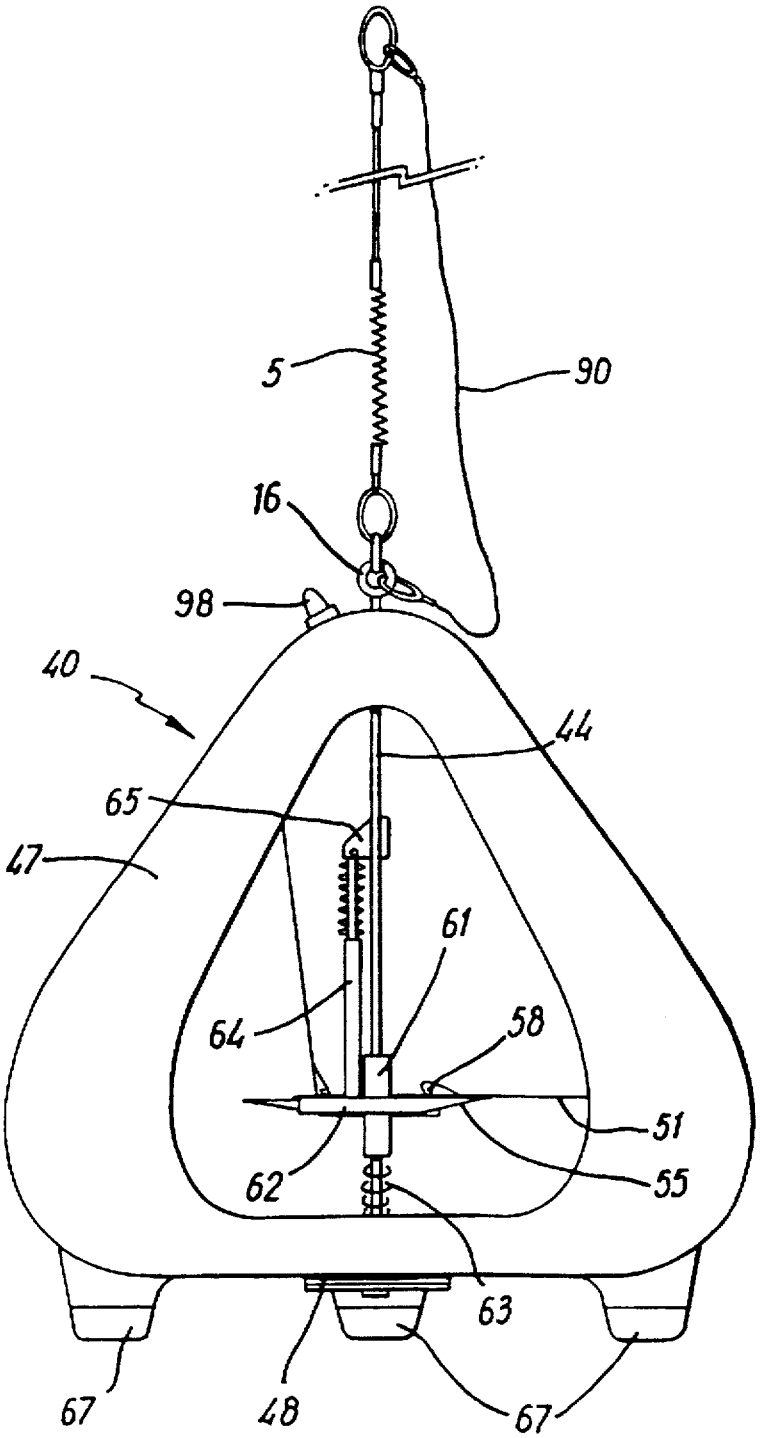
FIG. 6 is a front elevation of the second example of the transfer capsule in FIG. 5, showing a suspension system.

As in the first example of a transfer system shown in FIG. 1, a sprung member 15 is provided in the suspension gear of the capsule 40 as shown in FIGS. 5 and 6. This allows a compensated landing system to be used, as described above for the first example of the transfer system.

When a line is attached to the lower side of the capsule 40 and tension is applied to the line, the member 15 will expand and contract to compensate for the variation in load on the lower line, in the same manner as that described above for the first transfer system.

A third example of a capsule 80 for use in the transfer system is shown in FIGS. 14 to 17. The shape of the outside of the capsule 80 is shown in FIGS. 14 to 17 and is defined but not necessarily constructed as follows:

Four identical spheres 81 are centred on the apexes of a tetrahedron. The spheres 81 are connected by sections of cylindrical pipe 82 whose diameter is equal to that of the spheres 81 and whose central axes coincide with the edges of the tetrahedron.

The capsule therefore has four faces. The plane of each face is tangential to the circumference of each of the three cylindrical sections of pipe 82 which form the side of each face. One such plane is defined as the base 83.

The outer shell 87 is constructed from moulded glass reinforced plastic (GRP), according to established methods. The outer fibreglass skin is approximately 10 mm thick to produce a strong monocoque construction.

A central steel shaft 44 passes through holes in the base 83 and apex 84 and is connected to the shell 87 by threading the ends of the shaft and fitting washers and nuts above and below the fibreglass at both base and apex. This shaft is also fitted with a lifting eye 16 at it upper end. The shaft 44 provides a support by which the capsule 80 may be lifted. The seating and stretcher attachment arrangement is also attached to the central shaft 44 and is as described above for the capsule 40.

The capsule is rendered buoyant by the addition of foam 9 attached to the sections 82 joining the base 83 and apex 84 of the capsule and at the apex itself. Additional buoyancy may by incorporated at the base of the capsule. The function of the buoyancy is to keep the capsule afloat and to provide its self righting characteristic. Sufficient buoyant foam will be used to ensure that in the event of immersion the passenger's upper body will remain above the water line. The buoyancy is evenly distributed around the frame to enhance the self-righting capabilities of the structure. Eccentric weight at the base is added in the form of a simple keel 85 to ensure the capsule is self-righting.

Three feet 86 are attached close to the corners of the base. These are made of a firm but compressible foam such as polyethylene, which provides shock absorption when the capsule is landed. The triangular arrangement of the feet ensures that the capsule will be as stable as possible when standing on an uneven surface.

The advantages of the invention are that the rigid cage of the capsule protects personnel and/or cargo from any direct impacts during transfer; personnel and cargo are secured in position by harness during transfers; personnel and cargo are protected against impact loads on the capsule by shock absorption in seating and shock absorption built onto the exterior of the capsule; the capsule is buoyant when loaded to prevent personnel or cargo becoming permanently submersed, if landed in water; and, the capsule is self righting when immersed in water to prevent personnel or cargo suffering prolonged submersion due to the orientation of the capsule in the water. In addition, the feature of a compensated landing system in the form of a sprung member in the suspension gear of the load (personnel carrier or otherwise) has the advantage of providing more control over the transfer operation. This system allows the load to be lifted from and landed onto the deck of a vessel while the supporting line remains in tension. This helps prevent the load being struck as a result of the relative upward motion of the vessel deck.

Advantages of the systems disclosed above over existing transfer systems are the rigidity, inherent strength, convenient shape and its self-righting characteristics, buoyancy and stability in water. The capsule is also stable when landed on an uneven surface such as the deck of a vessel at sea. These properties arise from the shape of the capsule and the positioning of buoyant material within this shape.

Also, the invention has the advantage of being able to provide sprung seating and provision for the attachment of a stretcher which offer protection against impact loading for personnel and freight during transfer.

Furthermore, the simple shape of the capsule is economical to manufacture using established moulding or fabricating techniques, and the profiled shape of the capsule reduces the chances of its hanging up or becoming caught on structures or obstacles whilst in use.

We claim:

1. Apparatus for transferring objects from a first location to a second location, where the locations are horizontally spaced, the apparatus comprises a transfer device adapted to be coupled to a lifting device, the transfer device comprising a central load bearing member which is adapted to be coupled to the lifting device, an outer structure which defines an inner space in which an object to be transferred may be located, the outer structure being coupled to the central load bearing member, and securing means to secure the object in the inner space of the transfer device during transfer, the securing means being coupled to the central load bearing member, and the securing means being spaced apart from the outer structure, the transfer device further comprising buoyancy means, wherein the transfer device is self-righting when in water.

2. Apparatus according to claim 1, wherein the object to be transferred is a person and the securing means comprises a seat and a harness.

3. Apparatus according to claim 1, wherein the outer structure is a cage.

4. Apparatus according to claim 1, wherein the buoyancy means comprises a substantially rigid closed cell material.

5. Apparatus according to claim 1, wherein the transfer device includes shock absorbing means to absorb impact of the transfer device with other objects.

6. Apparatus according to claim 5, wherein the apparatus also includes a guideline coupled between the transfer device and the second location to guide the transfer device to the second location.

7. Apparatus according to claim 5, wherein the shock absorbing means includes shock absorbers on a base of the outer structure to absorb the shock of landing.

8. Apparatus according to claim 5, wherein the shock absorbing means includes second shock absorbing means mounted between the securing means and the outer structure, so that the securing means is coupled to the outer structure by the second shock absorbing means.

9. Apparatus according to claim 8 wherein the apparatus also includes a third shock absorbing means coupled between the transfer device and the lifting device.

10. Apparatus according to claim 8, wherein the securing means is slidably mounted on the central load bearing member by the second shock absorbing means.

11. Apparatus according to claim 5, wherein the outer structure comprises a base section and a number of side walls, the side walls extending from the base section to a common apex, the base section and the side walls defining the inner space.

12. Apparatus according to claim 11, wherein the base section has a polygonal shape.

13. Apparatus according to claim 12, wherein the shape formed by the base section and the side walls is generally the shape of a pyramid.

14. Apparatus according to claim 13, wherein the pyramid is a triangular pyramid or tetrahedron.

15. Apparatus according to claim 11, wherein the outer structure is coupled to the central load bearing member at the common apex and the base section of the outer structure.

16. Apparatus according to claim 11, wherein the buoyancy means include buoyancy material mounted on the side walls, and the base section.

17. Apparatus according to claim 11, wherein the buoyancy means include buoyancy material mounted on the said common apex.

* * * * *

UNITED STATES PATENT AND TRADEMARK OFFICE

CERTIFICATE OF CORRECTION

PATENT NO. : 5,713,710

DATED : Feb. 3, 1998

INVENTOR(S) : Strong et al.

It is certified that error appears in the above-identified patent and that said Letters Patent is hereby corrected as shown below:

On the title page, Item

[56] References Cited
U.S. Patent Documents:
Sixth listed document should read as follows:
4,180,362 12/1979 Stair ..... 414/139.5

Signed and Sealed this

Nineteenth Day of May, 1998

Bruce Lehman

*Attest:*

BRUCE LEHMAN

*Attesting Officer*

*Commissioner of Patents and Trademarks*